US006072509A

United States Patent [19]

Wen et al.

[11] Patent Number: 6,072,509

[45] **Date of Patent: *Jun. 6, 2000**

[54] MICROFLUIDIC PRINTING WITH INK VOLUME CONTROL

[75] Inventors: Xin Wen, Rochester; Charles D. Deboer, Palmyra; Werner Fassler, Rochester, all of N.Y.

[73] Assignee: Eastman Kodak Company, Rochester, N.Y.

[ * ] Notice: This patent is subject to a terminal disclaimer.

[21] Appl. No.: 08/868,102

[22] Filed: Jun. 3, 1997

[51] Int. Cl.[7] ..... B41J 2/005

[52] U.S. Cl. ..... 346/140.1; 347/43

[58] Field of Search ..... 346/140.1; 347/54; 251/367, 368, 129.16

[56] References Cited

U.S. PATENT DOCUMENTS

| | | | |
|---|---|---|---|
| 4,072,959 | 2/1978 | Elmqvist | 347/68 |
| 5,023,625 | 6/1991 | Bares et al. | 347/48 |
| 5,178,190 | 1/1993 | Mettner | 251/368 |
| 5,238,223 | 8/1993 | Mettner et al. | 251/367 |
| 5,259,737 | 11/1993 | Kamisuki et al. | 417/322 |
| 5,367,878 | 11/1994 | Muntz et al. | 399/230 |
| 5,400,824 | 3/1995 | Gschwendtner et al. | 251/129.06 |
| 5,585,069 | 12/1996 | Zanzucchi et al. | 422/100 |
| 5,593,838 | 1/1997 | Zanzucchi et al. | 435/6 |
| 5,603,351 | 2/1997 | Cherukuri et al. | 137/597 |
| 5,611,847 | 3/1997 | Guistina et al. | 106/499 |
| 5,745,128 | 4/1998 | Lam et al. | 346/140.1 |
| 5,771,810 | 6/1998 | Wolcott | 347/3 |

OTHER PUBLICATIONS

Dasgupta et al., "Electroosmosis: A Reliable Fluid Propulsion System for Flow Injection Analyses", Anal. Chem. 66, pp. 1792–1798 (1994).

*Primary Examiner*—N. Le
*Assistant Examiner*—Lamson D. Nguyen
*Attorney, Agent, or Firm*—Raymond L. Owens

[57] ABSTRACT

A microfluidic printing apparatus includes plurality of ink reservoirs containing cyan, magenta, and yellow inks, respectively and a plurality of ink mixing chambers each for applying a dot of mixed ink to a receiver and a plurality of microchannels connecting each of the reservoirs to a mixing chamber. The apparatus further includes a plurality of microfluidic pumps each being associated with a single microchannel for supplying a particular ink into a particular mixing chamber and microvalves associated with each channel and moveable between two positions for blocking and permitting the flow of ink from the associated microchannel into its associated mixing chamber to regulate the ink flow into the ink mixing chambers, and controlling the microfluidic pumps and microvalves for causing the correct amount of colored ink to be conveyed into each mixing chamber.

11 Claims, 4 Drawing Sheets

MICROFLUIDIC PRINTING WITH INK VOLUME CONTROL

CROSS REFERENCE TO RELATED APPLICATIONS

Reference is made to commonly assigned U.S. Patent Application Ser. No. 08/868,426, filed concurrently herewith entitled "Continuous Tone Microfluidic Printing", by DeBoer, Fassler, and Wen. The disclosure of this related application is incorporated herein by reference.

FIELD OF THE INVENTION

The present invention relates to printing digital images by microfluidic pumping of colored inks to prevent smearing and overload of the printed pixels.

BACKGROUND OF THE INVENTION

Microfluidic pumping and dispensing of liquid chemical reagents is the subject of three U.S. Pat. Nos. 5,585,069; 5,593,838; and 5,603,351, all assigned to the David Sarnoff Research Center, Inc., and hereby incorporated by reference. The system uses an array of micron sized reservoirs, with connecting microchannels and reaction cells etched into a substrate. Electrokinetic pumps comprising electrically activated electrodes within the microchannels provide the propulsive forces to move the liquid reagents within the system. The electrokinetic pump, which is also known as an electroosmotic pump, has been disclosed by Dasgupta et al., see "Electroosmosis: A Reliable Fluid Propulsion System for Flow Injection Analyses", Anal. Chem. 66, pp 1792–1798 (1994). The chemical reagent solutions are pumped from a reservoir, mixed in controlled amounts, and then pumped into a bottom array of reaction cells. The array can be decoupled from the assembly and removed for incubation or analysis.

The above described microfluidic pumping can be used as a printing apparatus. The chemical reagent solutions are replaced by dispersions of cyan, magenta, and yellow pigment. The array of reaction cells may be considered a viewable display of picture elements, or pixels, comprising mixtures of pigments having the hue of the pixel in the original scene. When contacted with paper, the capillary force of wetting the paper fibers pulls the dye from the cells and holds it in the paper, thus producing a paper print, or photograph, of the original scene.

For printing a photographic quality image, it is desirable to print a continuous tone scale of colored inks. Such a continuous tone printing apparatus, based on the microfluidic printing as described, has been disclosed in the above cross referenced and commonly assigned copending U.S. patent application Ser. No. 08/868,426, filed concurrently herewith entitled "Continuous Tone Microfluidic Printing", by DeBoer, Fassler, and Wen. The disclosure of this related application is incorporated herein by reference. In U.S. patent application Ser. No. 08/868,426, a colorless ink is mixed with the colored ink mixtures to make colored inks of different degree of color saturation at each pixel, which is needed for a continuous tone image.

A problem with microfluidic printing is in the control of the amount of inks transferred from the printing apparatus to the receiver medium. During printing, the ink meniscus in the ink mixing pixel chambers are brought into contact with the receiver medium. The inks are absorbed by the receiver medium by action of the wetting of the fibers or pores in the receiver medium. Since the capillary force in the receiver medium is typically much stronger than the holding strength of the microchannels in the microfluidic printing apparatus, the ink transfer needs to be stopped at just the right time to prevent excess ink from being continually drawn from the microchannels in the microfluidic printing apparatus. The control of the ink transfer time is particularly difficult in conditions where the temperature may vary, because the rate of flow of the ink will be temperature sensitive. As it is well known to the persons skilled in the art, excessive ink transfer to the receiver medium typically causes severe coalescence or smearing of the ink on the receiver medium, which produces visible image artifacts and lowers the printing resolution Excess ink transfer also causes excess bleeding between inks of different colors which produces image defects and variabilities in color balance.

SUMMARY OF THE INVENTION

An object of this invention is to provide high quality digital print images without severe coalescing and smearing of ink.

Another object of this invention is to control the ink transfer volume of a microfluidic printer.

A further object of this invention is to provide a printing apparatus which controls the volume of ink transferred and produces continuous tone images.

These objects are achieved by a microfluidic printing apparatus comprising:

a) a plurality of ink reservoirs containing cyan, magenta, and yellow inks, respectively;

b) a plurality of ink mixing chambers each for applying a dot of mixed ink to a receiver and a plurality of microchannels connecting each of the reservoirs to a mixing chamber;

c) a plurality of microfluidic pumps each being associated with a single microchannel for supplying a particular ink into a particular mixing chamber;

d) microvalves associated with each channel and moveable between two positions for blocking and permitting the flow of ink from the associated microchannel into its associated mixing chamber to regulate the ink flow into the ink mixing chambers; and e) control means for controlling the microfluidic pumps and microvalves for causing the correct amount of colored ink to be conveyed into each mixing chamber.

ADVANTAGES

One feature of the present invention is that it reduces image artifacts in microfluidic printing such as coalescence and inter-color bleeding between ink drops on the receiver.

A further feature of the invention is to permit the printing of continuous tone images wherein each ink dot has the correct mixture of inks.

Another feature of the present invention is that the invention microfluidic printing apparatus can print on a wide variety of receiver media.

Another feature of the invention is that the printing process is fast, because all the pixels are printed simultaneously.

Another feature of the invention is that registration errors, banding and other placement error defects are greatly reduced because all the pixels are printed simultaneously.

DETAILED DESCRIPTION OF THE INVENTION

The present invention is described in relation to a microfluidic printing apparatus which can print computer generated images, graphic images, line art, text images and the like, as well as continuous tone images as described in commonly assigned U.S. patent application Ser. No. 08/868,426, filed concurrently herewith entitled "Continuous Tone Microfluidic Printing", by DeBoer, Fassler, and Wen. The disclosure of this related application is incorporated herein by reference.

Figure 1:
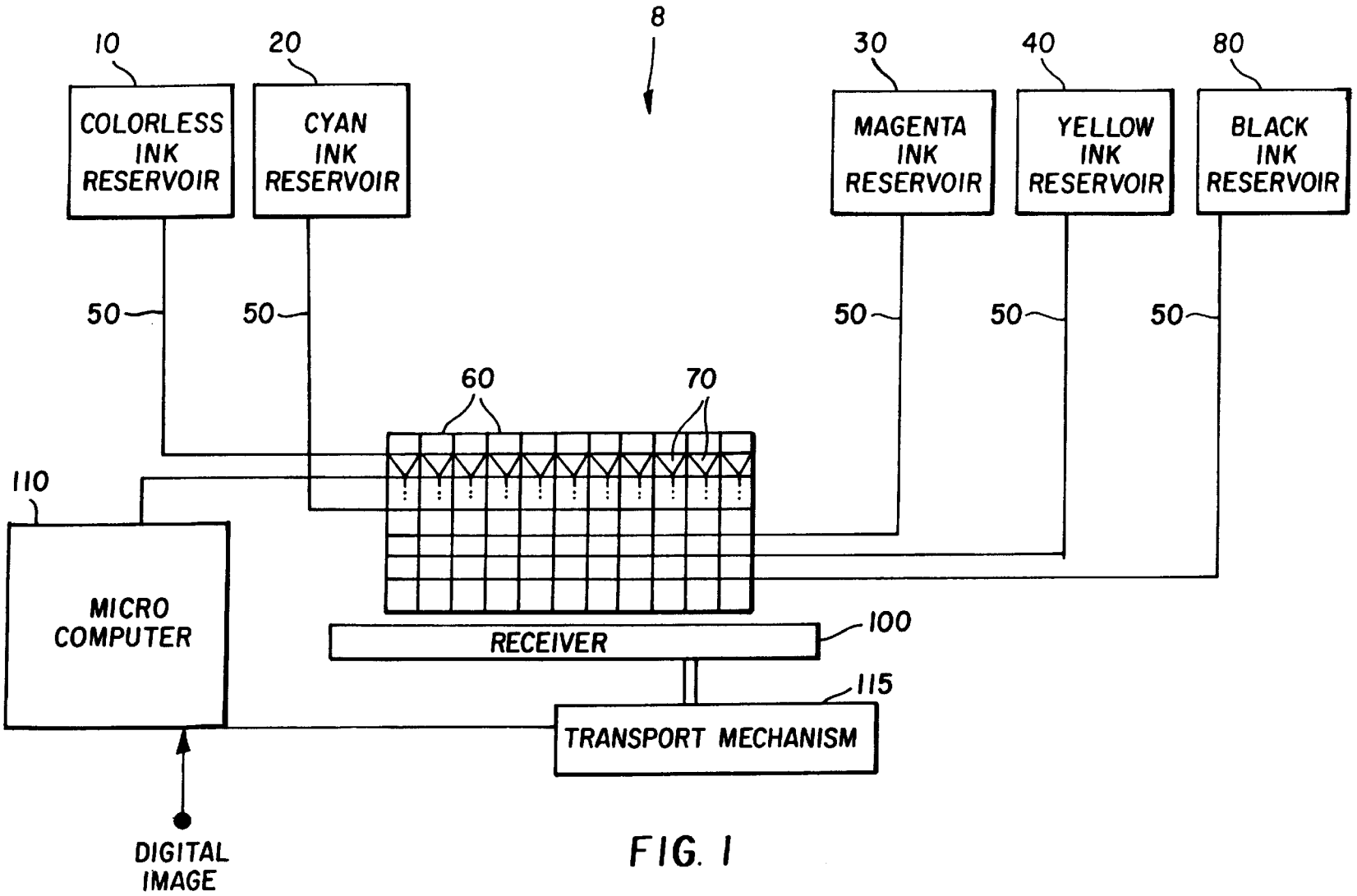
FIG. 1 is a partial schematic view showing a printing apparatus for pumping, mixing and printing pixels of ink onto a reflective receiver.
Figure 2:
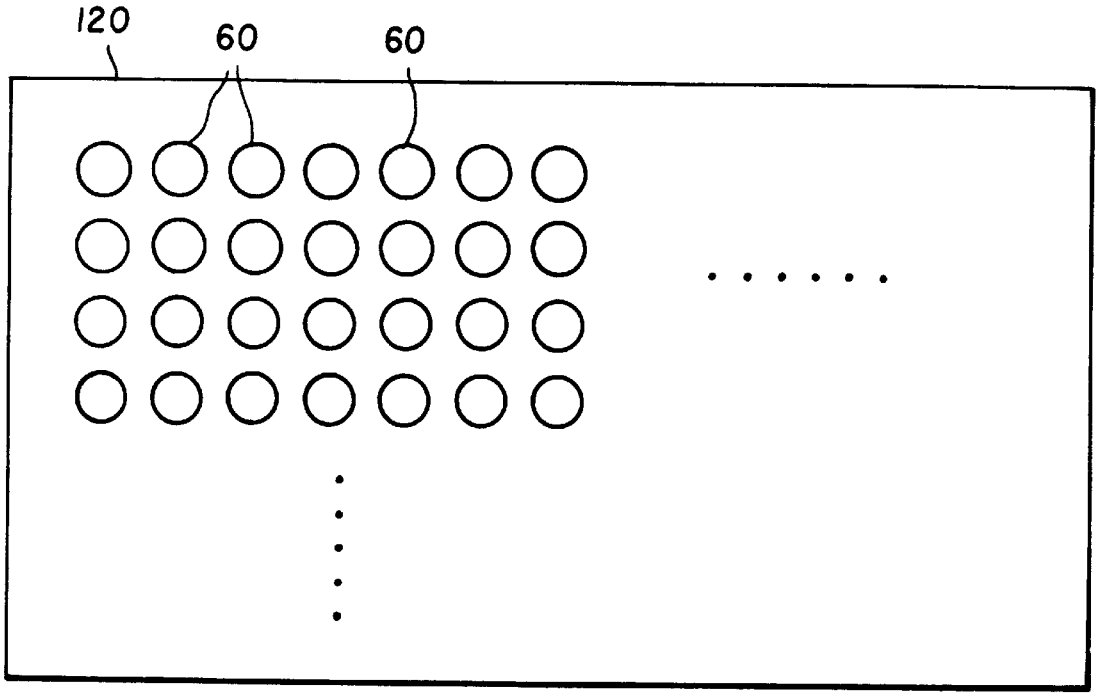
FIG. 2 is a top view of the pattern of the color pixels described in the present invention.

Referring to FIG. 1, a schematic diagram is shown of a printing apparatus 8 in accordance with the present invention. Reservoirs 10, 20, 30, and 40 are respectively provided for holding colorless ink, cyan ink, magenta ink, and yellow ink. An optional reservoir 80 is shown for black ink. Microchannel capillaries 50 respectively connected to each of the reservoirs conduct ink from the corresponding reservoir to an array of ink mixing chambers 60. In the present invention, the ink mixing chambers 60 deliver the ink directly to a receiver; however, other types of ink delivery arrangements can be used such as microfluidic channels, and so when the word chamber is described, it will be understood to include those arrangements. The colored inks are delivered to ink mixing chambers 60 by electrokinetic pumps 70. The amount of each color ink is controlled by microcomputer 110 according to the input digital image. For clarity of illustration, only one electrokinetic pump 70 is shown for the colorless ink channel. Similar pumps are used for the other color channels, but these are omitted from the figure for clarity. Finally, a receiver 100 is transported by a transport mechanism to come in contact with the microfluidic printing apparatus. The receiver 100 accepts the ink and thereby produce the print.

The inks used in this invention are dispersions of colorants in common solvents. Examples of such inks may be found is U.S. Pat. No. 5,611,847 by Gustina, Santilli, and Bugner. Inks may also be found in the following commonly assigned U.S. patent application Ser. Nos. 08/699,955 filed Aug. 20, 1996 by McInerney, Oldfield, Bugner, Bermel, and Santilli; 08/699,692 filed Aug. 20, 1996 by McInerney, Oldfield, Bugner, Bermel, and Santilli; and 08/699,963 filed Aug. 20, 1996 by McInerney, Oldfield, Bugner, Bermel, and Santilli; 08/790,131 filed Jan. 29, 1997 by Bishop, Simons and Brick; and 08/764,379 filed Dec. 13, 1996 by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. The colorless ink of this invention is the solvent for the colored inks in the most preferred embodiment of the invention.

The microchannel, ink pixel mixing chambers, and microfluidic pumps are described in the patents listed above.

Figure 3:
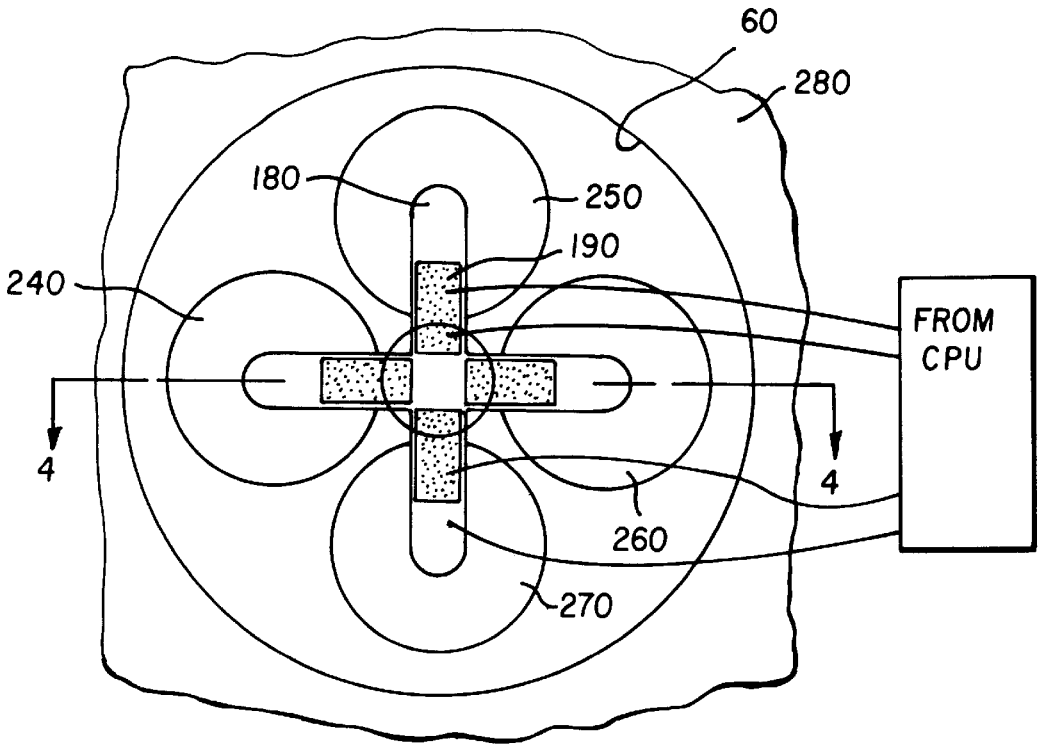
FIG. 3 is a detailed plan view of ink mixing chambers of the microfluidic printing apparatus in the present invention.
Figure 4:
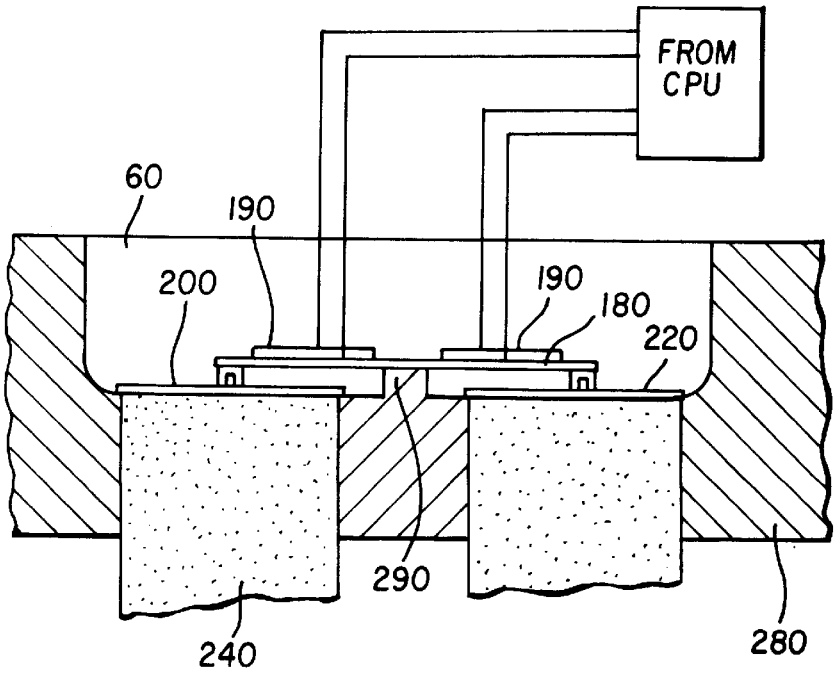
FIG. 4 is a cross-sectional view taken along the lines 4—4 of FIG. 3 and showing closed microvalves.
Figure 5:
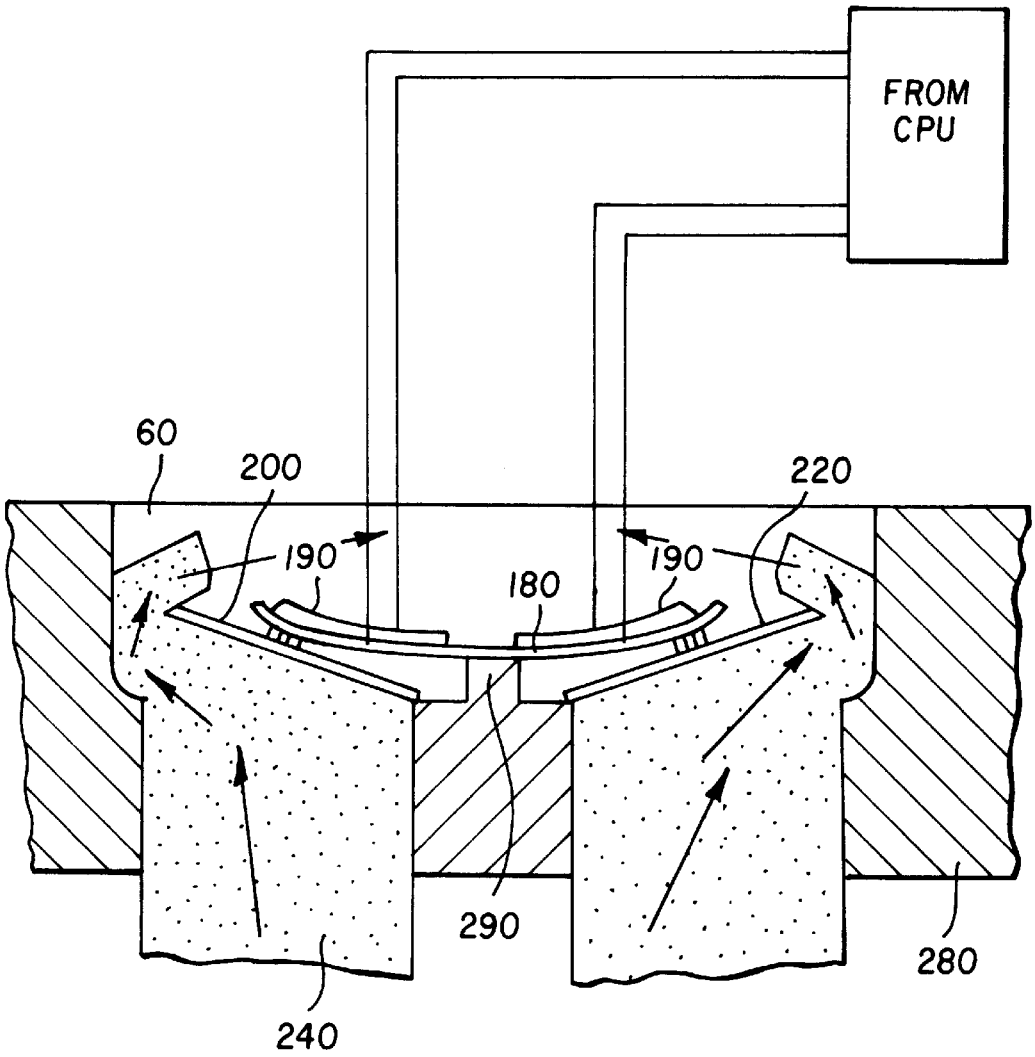
FIG. 5 is a cross-sectional view similar to that of FIG. 4 with the microvalves shown in open position.

FIG. 3 shows a detailed plan view of the ink mixing chamber of microfluidic printing apparatus in the present invention. FIG. 4 is a cross-sectional view of the ink mixing chamber as shown in FIG. 3 with closed microvalves. microvalve includes a micro-shutter (see 200 or 220), a piezo plate 190, and a microbeam 180. FIG. 5 is a cross-sectional view of the ink mixing chamber as shown in FIG. 3 with opened microvalves. For clarity of illustration, the black ink flow channel is not shown in FIGS. 3–5. Each ink mixing chamber 60 is fabricated in a glass substrate 280. Each ink mixing chamber 60 is connected to microchannels 240, 250, 260 and 270 for colorless, cyan, magenta and yellow inks respectively. The microchannels 240, 250, 260 and 270 for receiving an electrokinetic pump which pumps ink from the corresponding ink reservoirs 10, 20, 30, 40 (FIG. 1) in accordance with electrical signals from the microcomputer 110. A microbeam 180, supported by a microbeam support 290, is attached to the micro-shutters for each ink (such as the micro-shutters 240 and 260 for colorless and magenta inks). The microbeam 180 is attached to several piezo plates 190 with each of the piezo plates 190 controlling the deflection of the beam and thus the opening of the micro-shutter for that color ink channel. A bimetallic actuator can also be used in place of the piezo plates 190 for deflecting the microbeam and regulating the micro-shutters (e.g. 200 and 220 etc.). In FIG. 4, the micro-shutters 240 and 260 are shown in a closed state with the piezoplates unactivated and the microbeam undeflected. In FIG. 5, the piezoplates are activated in a bend mode, the microbeam 180 deflected, and the micro-shutters 200 and 220 are in an open state.

Many other types of microvalves can be used for the present invention. One example is a microvalve comprising a bimetallically driven diaphragms as described in p26 Sensor, September, 1994. Other types of microvalves are disclosed in U.S. Pat. Nos. 5,178,190, 5,238,223, 5,259,737, 5,367,878, and 5,400,824.

The typical printing operation in the present invention involves the following steps. First the microcomputer 110 that controls the printer receives a digital image file consisting of electronic signals in which the color code values are characterized by bit depths of an essentially continuous tone image, for example, 8 bits per color per pixel. The color code values at each pixel, define the lightness, hue and color saturation at the pixel. In the default non-printing mode, the micro-shutters 200, 220, etc. are closed. This prevents ink solutions from drying up at the outlets of the microchannels which often causes kogation problems in the microchannels. When the printing command is received from the microcomputer 110, electric activation pulses are sent to bend the piezo plates 190 and deflect the microbeam 180, and open up the microshutters such as 200, 220, etc. for the microchannels 240, 250, 260 and 270 for each ink. The electrokinetic pumps connected to the corresponding microchannels 240, 250, 260, and 270 around each ink mixing chamber 60 pump the designated cyan, magenta, yellow, and clear inks in an amount corresponding to the code values at the pixel from the ink reservoirs 20, 30, 40 and 80, into the ink mixing chamber 60. Again, the black ink can be included for appropriate printing applications. After the pumping of the inks is completed, the micro-shutters such as 200 and 220 are closed. The mixture of inks, which has the same hue, lightness and color saturation as the corresponding pixel of the original image being printed, is held in the mixing chamber 60 by the surface tension of the ink solution. The reflective receiver 100 is subsequently placed in contact with the ink meniscus of the ink mixing chambers 60 within the printer front plate 120. The mixture of inks contained in the mixing chamber 60 is then drawn into the reflective receiver by the absorbing force (such as capillary action) of the pores in the receiver. Since the ink mixture in ink mixing chamber 60 is shut off from the ink reservoir in the printing apparatus, the contact time for the ink transfer is no longer critical. In addition, the because the ink mixture in ink mixing chamber 60 is isolated, the requirement on the receiver type is much relaxed. Any receiver medium 100 is applicable to this invention printing apparatus as long as it is capable of absorbing the ink fluids.

One important advantage of the present invention is the reduction of the printing image defects that commonly occur when the cyan, magenta and yellow inks are printed in separate operations. Misregistration of the apparatus often leads to visible misregistration of the color planes being printed. In this invention, all the color planes are printed simultaneously; thus eliminating such misregistration.

Ink from the black ink reservoir 80 can be included in the colored mixtures to improve the density of dark areas of the print, or may be used alone to print text, or line art, if such is included in the image being printed.

The invention has been described in detail with particular reference to certain preferred embodiments thereof, but it will be understood that variations and modifications can be effected within the spirit and scope of the invention.

What is claimed is:

1. A microfluidic printing apparatus for transferring ink to a receiver comprising:

a) at least one ink reservoir;

b) a plurality of delivery chambers each for forming an ink pixel, and a plurality of microchannels each connecting the reservoir to each said chamber;

c) a plurality of electrokinetic pumps each being associated with each said microchannel for supplying ink to a particular delivery chamber;

d) a plurality of microvalves each associated with each microchannel and moveable between two positions for blocking and permitting the flow of ink from the associated microchannel into its associated delivery chamber to regulate the ink flow into the delivery chambers; and e) control means for controlling the electrokinetic pumps and microvalves for causing a correct amount of ink to be conveyed into each delivery chamber.

2. The apparatus of claim 1 wherein each microvalve includes a micro-shutter which is moveable between ink blocking and unlocking positions and a microbeam which is operatively associated with the micro-shutter and effective in a first position for causing the micro-shutter to be in its blocking position and in a second position for causing the micro-shutter to be in its unlocked position and means for controlling the position of the microbeam to move the micro-shutter to a selected open position to regulate the amount of flow from the microchannel into the mixing chamber.

3. The apparatus of claim 2 wherein the microbeam controlling means includes a piezoelectric plate which, in response to an electrical signal, is effective to move the microshutter between its blocking and unblocking position.

4. A microfluidic printing apparatus for transferring ink to a receiver comprising:

a) a plurality of ink reservoirs containing cyan, magenta, and yellow inks, respectively;

b) a plurality of ink mixing chambers each for applying a dot of mixed ink to the receiver and a plurality of microchannels each connecting each of the reservoirs to each said mixing chamber;

c) a plurality of electrokinetic pumps each being associated with each single microchannel for supplying a particular ink into a particular mixing chamber;

d) microvalves each associated with each microchannel and moveable between two positions for blocking and permitting the flow of ink from the associated microchannel into its associated mixing chamber to regulate the ink flow into the ink mixing chamber; and e) control means for controlling the electrokinetic pumps and microvalves for causing a correct amount of colored ink to be conveyed into each mixing chamber.

5. The apparatus of claim 4 wherein each microvalve includes a micro-shutter which is moveable between ink blocking and unlocking positions and a microbeam which is operatively associated with the micro-shutter and effective in a first position for causing the micro-shutter to be in its blocking position and in a second position for causing the micro-shutter to be in its unlocked position and means for controlling the position of the microbeam to move the micro-shutter to a selected open position to regulate the amount of flow from the microchannel into the mixing chamber.

6. The apparatus of claim 5 wherein the microbeam controlling means includes a piezoelectric plate which, in response to an electrical signal, is effective to move the microshutter between its blocking and unblocking position.

7. A microfluidic printing apparatus for transferring ink to a receiver:

a) a plurality of ink reservoirs containing cyan, magenta, yellow, and colorless inks, respectively;

b) a plurality of ink mixing chambers each for applying a dot of mixed ink to the receiver and a plurality of microchannels each connecting each of the reservoirs to each said mixing chamber;

c) a plurality of electrokinetic pumps each being associated with each single microchannel for supplying a particular ink into a particular mixing chamber;

d) microvalves each associated with each microchannel and moveable between a blocking position and a plurality of unblocked positions permitting the flow of a selected amount of ink from an associated microchannel into its associated mixing chamber to regulate the ink flow into the ink mixing chamber; and e) control means including a microcomputer for controlling the electrokinetic pumps and microvalves for causing a correct amount of colored ink to be conveyed into each mixing chamber to thereby provide a continuous tone image.

8. The apparatus of claim 7 wherein each microvalve includes a micro-shutter which is moveable between ink blocking and unblocking positions and a microbeam which is operatively associated with the micro-shutter and effective in a first position for causing the micro-shutter to be in its blocking position and in a second position for causing the micro-shutter to be in its unblocked position and means for controlling the position of the microbeam to move the micro-shutter to a selected open position to regulate the amount of flow from the microchannel into the mixing chamber.

9. The apparatus of claim 7 wherein the microbeam controlling means includes a piezoelectric plate which, in response to an electrical signal, is effective to move the microshutter between its blocking and unblocking position.

10. A method for microfluidic ink printing for transferring ink to a receiver comprising the steps of:

a) providing a plurality of ink reservoirs containing cyan, magenta, and yellow inks, respectively;

b) providing a plurality of ink mixing chambers each for applying a dot of mixed ink to the receiver and a plurality of microchannels each connecting each of the reservoirs to each said mixing chamber;

c) supplying ink by a plurality of electrokinetic pumps each being associated with each single microchannel into a particular ink into a particular mixing chamber;

d) regulating the flow of ink from each microchannel into each mixing chamber from each microchannel; and e) controlling the electrokinetic pumps and regulation of ink flow for causing a correct amount of colored ink to be conveyed into each mixing chamber.

11. A method for microfluidic ink printing for transferring ink to a receiver comprising the steps of:

a) providing a plurality of ink reservoirs containing cyan, magenta, yellow, and colorless inks, respectively;

b) providing a plurality of ink mixing chambers each for applying a dot of mixed ink to the receiver and a plurality of microchannels each connecting each of the reservoirs to each said mixing chamber;

c) supplying ink by a plurality of electrokinetic pumps each being associated with each single microchannel into a particular ink into a particular mixing chamber;

d) regulating the flow of ink from each microchannel into each mixing chamber from each microchannel; and e) controlling the electrokinetic pumps and regulation of ink flow for causing a correct amount of colored ink to be applied into each mixing chamber to thereby produce a continuous tone image.

* * * * *